United States Patent [19]

Gulley

[11] Patent Number: 4,936,499

[45] Date of Patent: Jun. 26, 1990

[54] TOOL CARRIER

[76] Inventor: James L. Gulley, 1150 S. Meadow La. #61, Colton, Calif. 92324

[21] Appl. No.: 396,115

[22] Filed: Aug. 21, 1989

[51] Int. Cl.[5] ..... A45F 5/00

[52] U.S. Cl. ..... 224/252; 224/904; 224/248; 224/255

[58] Field of Search ..... 224/904, 224, 225, 226, 224/232, 234, 251–253, 255, 269, 248, 32 R, 41, 36, 34, 42.45 R, 42.46 R; 248/302, 303, 314; 211/70.6, 119; 24/3 D, 3 L, 3 H, 287; 220/85 H, 95; 206/806

[56] References Cited

U.S. PATENT DOCUMENTS

| | | | |
|---|---|---|---|
| 2,202,798 | 5/1940 | House | 248/302 |
| 3,458,095 | 7/1969 | Stall | 224/42.42 R |
| 4,315,583 | 2/1982 | Hine, Jr. | 224/36 |
| 4,644,610 | 2/1987 | Fish | 211/70.6 |
| 4,706,804 | 11/1978 | Hall | 206/806 |
| 4,809,894 | 3/1989 | Vilo | 224/251 |

*Primary Examiner*—Henry J. Recla

*Assistant Examiner*—Keith Kupferschmid

*Attorney, Agent, or Firm*—Jerry T. Kearns

[57] ABSTRACT

A tool carrier has a frame formed from a closed wire loop which includes a tool insertion portion having spaced side rail members connected by an arcuate end bar. An attachment portion of the frame has spaced attachment rail members each connected by a ninety degree bend with one of said side rail members. A clip portion of the frame includes a pair of spaced clip members connected by an arcuate connecting bar, with each of clip members connected by a 180 degree bend with one of the attachment rail members to form a resilient frictional clip for securement to an article of apparel of an individual. A variety of different removable receptacles are disclosed for removable securement in the tool insertion portion of the frame. The various receptacles may be utilized to carry small articles, scissors, and a variety of other tools. The tool carrier frame is dimensioned to receive a conventional hammer with the receptacle removed from the tool insertion portion.

15 Claims, 4 Drawing Sheets

TOOL CARRIER

BACKGROUND OF THE INVENTION

1. Field of the Invention

The present invention relates to tool carriers, and more particularly pertains to a tool carrier which allows an individual to conveniently transport a variety of conventional tools. A variety of conventional tool carriers have been proposed which require attachment to a large and cumbersome belt. These devices frequently include leather loops which easily collapse, which making tool replacement an inconvenient task. Additionally, conventional forms of tool belts are relatively heavy and expensive. In order to overcome these problems, and to provide an extremely versatile tool carrier for conveniently transporting a variety of tools, the present invention discloses a tool carrier formed from a closed wire loop and dimensioned to removably retain a tool carrying receptacle.

2. Description of the Prior Art

Various types of tool carriers are known in the prior art. A typical example of such a tool carrier is to be found in U.S. Pat. No. 1,326,887, which issued to W. Wood on Dec. 30, 1919. This patent discloses a tool carrier formed from a deformed length of wire and including a frictional clip portion for engagement with the belt of an individual. U.S. Pat. No. 3,104,434, which issued to L. Noordhoek on Sep. 24, 1963, discloses a hammer holder formed from a deformed length of wire and including a resilient belt engaging clip. U.S. Design Pat. No. 261,197, which issued to D. Rowswell on Oct. 13, 1981, discloses a belt attachable hammer holder including perpendicular clip and tool insertion portions. U.S. Pat. No. 4,457,462, which issued to U. Taormina on Jul. 3, 1984, discloses a tool carrier having a circular wire loop perpendicularly connected to a resilient belt clip portion. U.S. Pat. No. 4,638,530, which issued to R. Perry on Jan. 27, 1987, discloses a hammer carrier including perpendicular tool insertion and clip portions which may be formed from wire or sheet metal.

While the above mentioned devices are directed to tool carriers, none of these devices disclose a tool carrier formed from a closed wire loop having perpendicular tool insertion and attachment portions and including a pair of converging clip members connected by approximately 180 radius bends with attachment rail members. Additional features of the present invention, include the provision of a set of variously configured removable receptacles, each having a peripheral groove for engagement with the wire frame portion, for retaining a wide variety of different tool items. Inasmuch as the art is relatively crowded with respect to these various types of tool carriers, it can be appreciated that there is a continuing need for and interest in improvements to such tool carriers, and in this respect, the present invention addresses this need and interest.

SUMMARY OF THE INVENTION

In view of the foregoing disadvantages inherent in the known types of tool carriers now present in the prior art, the present invention provides an improved tool carrier. As such, the general purpose of the present invention, which will be described subsequently in greater detail, is to provide a new and improved tool carrier which has all the advantages of the prior art tool carriers and none of the disadvantages.

To attain this, representative embodiments of the concepts of the present invention are illustrated in the drawings and make use of a tool carrier which has a frame formed from a closed wire loop which includes a tool insertion portion having spaced side rail members connected by an arcuate end bar. An attachment portion of the frame has spaced attachment rail members each connected by a ninety degree bend with one of said side rail members. A clip portion of the frame includes a pair of spaced clip members connected by an arcuate connecting bar, with each of clip members connected by a 180 degree bend with one of the attachment rail members to form a resilient frictional clip for securement to an article of apparel of an individual. A variety of different removable receptacles are disclosed for removable securement in the tool insertion portion of the frame. The various receptacles may be utilized to carry small articles, scissors, and a variety of other tools. The tool carrier frame is dimensioned to receive a conventional hammer with the receptacle removed from the tool insertion portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool carrier which has all the advantages of the prior art tool carriers and none of the disadvantages.

It is another object of the present invention to provide a new and improved tool carrier which may be easily and efficiently manufactured and marketed.

It is a further object of the present invention to provide a new and improved tool carrier which is of a durable and reliable construction.

An even further object of the present invention is to provide a new and improved tool carrier which is susceptible of a low cost of manufacture with regard to both materials and labor, and which accordingly is then susceptible of low prices of sale to the consuming public, thereby making such tool carriers economically available to the buying public.

Still yet another object of the present invention is to provide a new and improved tool carrier which provides in the apparatuses and methods of the prior art some of the advantages thereof, while simultaneously overcoming some of the disadvantages normally associated therewith.

Still another object of the present invention is to provide a new and improved tool carrier which allows a variety of tools to be conveniently carried by an individual without requiring the use of tool belt.

Yet another object of the present invention is to provide a new and improved tool carrier which includes a selectively removable receptacle for converting the tool carrier for usage with various different types of tools.

Even still another object of the present invention is to provide a new and improved tool carrier formed from a closed wire loop and having a removable tool carrier with a peripheral groove for frictional engagement with a tool insertion portion of the wire loop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
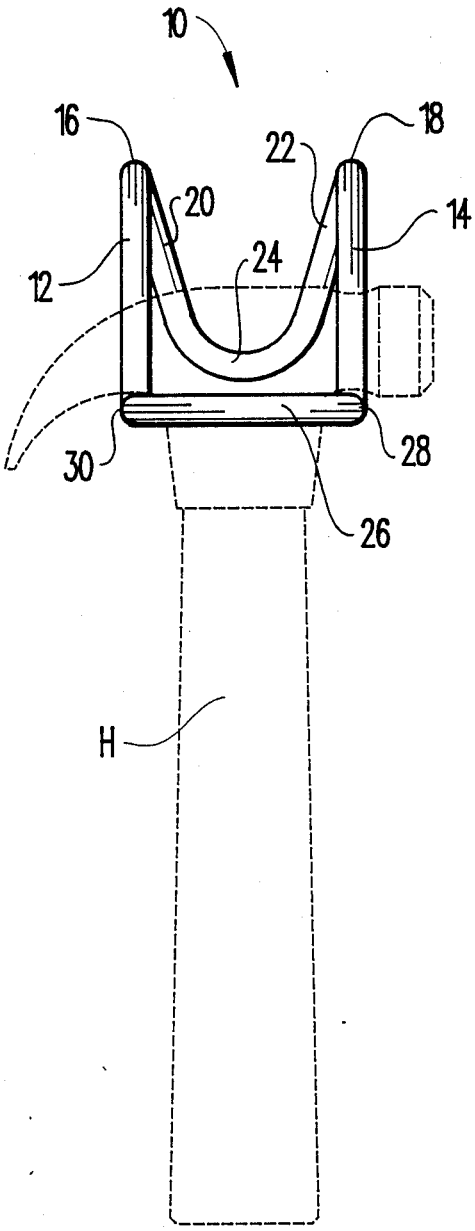
FIG. 1 is a front view of the tool carrier according to the first embodiment of the present invention, diagrammatically illustrating the manner of carrying a hammer.

With reference now to the drawings, and in particular to FIG. 1 thereof, a new and improved tool carrier embodying the principles and concepts of the present invention and generally designated by the reference numeral 10 will be described.

More specifically, it will be noted that the first embodiment 10 of the invention includes a frame formed from a closed loop of wire. The frame is preferably formed from a nine gauge heavy wire band that is about three inches wide by six and a half inches in length, and of a generally flattened oval configuration. The tool carrier frame includes a tool insertion portion having spaced opposed side rail members 28 and 30 connected by an arcuate end bar 26. The side rail members 28 and 30 and the end bar 26 lie in a common plane. A pair of spaced attachment rail members 12 and 14 are each connected by an approximately 90 degree radius bend with one of the side rail members 28 and 30 and lie in a common plane generally perpendicular to the plane of the side rail members 28 and 30. A pair of converging clip members 20 and 22 are each connected by an approximately 180 degree radius bend with one of the attachment rail members 12 and 14. The clip members 20 and 22 are connected by an arcuate connecting bar 24 and form a resilient frictional clip for securement to an article of apparel of an individual. The tool carrier 10 may be secured to a belt, to a trouser waist band, or in a trouser pocket. The heavy gauge wire construction prevents the tool carrier from collapsing, making tool insertion and removal a simple and expedient operation. The tool carrier 10 is illustrated as a carrier for a conventional hammer H.

Figure 2:
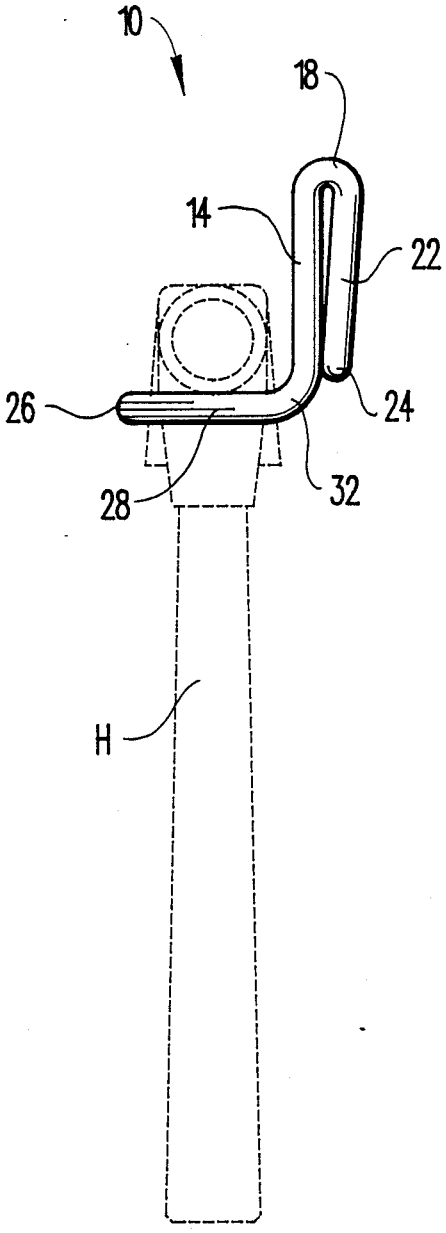
FIG. 2 is a side view of the tool carrier of FIG. 1.

As shown in the side view of FIG. 2, the side rail member 28 is connected with the attachment rail member 14 by a 90 degree radius bend 32. The attachment rail member 14 is connected at an opposite end by a 180 degree radius bend 18 with the clip member 22. A similar 180 degree radius bend 16 connects the attachment rail member 12 with the clip member 20, as shown in FIG. 1.

Figure 3:
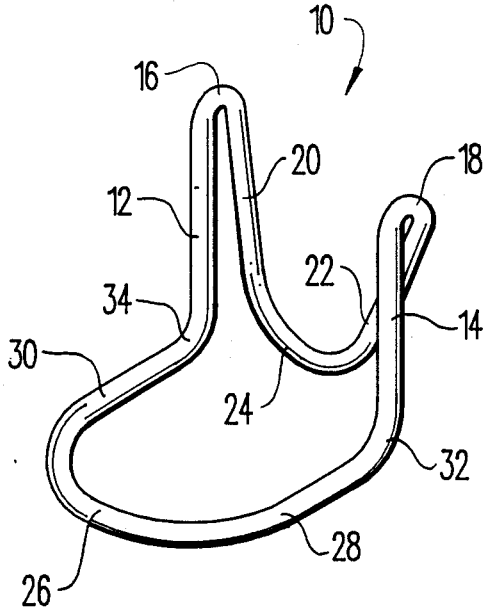
FIG. 3 is a perspective view of the tool carrier of FIG. 1.

FIG. 3 is a perspective view of the tool carrier 10 which illustrates the 90 degree radius bend 34 which connects the side rail member 30 with the attachment rail member 12. As may now be understood, the clip members 20 and 22 form a frictional clip for clamping an article of apparel between the clip members 20 and 22 and the attachment rail members 12 and 14. The heavy gauge wire of the tool carrier 10 is sufficiently resilient to allow a small degree of elastic deformation which allows securement and removal of the tool carrier 10 from a belt or other article of apparel.

Figure 4:
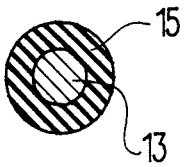
FIG. 4 is a transverse cross sectional view of the wire frame of the tool carrier of FIG. 1, illustrating an optional friction enhancing coating.

As shown in FIG. 4, the heavy gauge wire 13 is preferably provided with a friction enhancing coating 15, which may be of the type sold under the trademark PLASTI-DIP. This coating prevents the carrier 10 from falling off the belt or other article of apparel of an individual.

Figure 5:
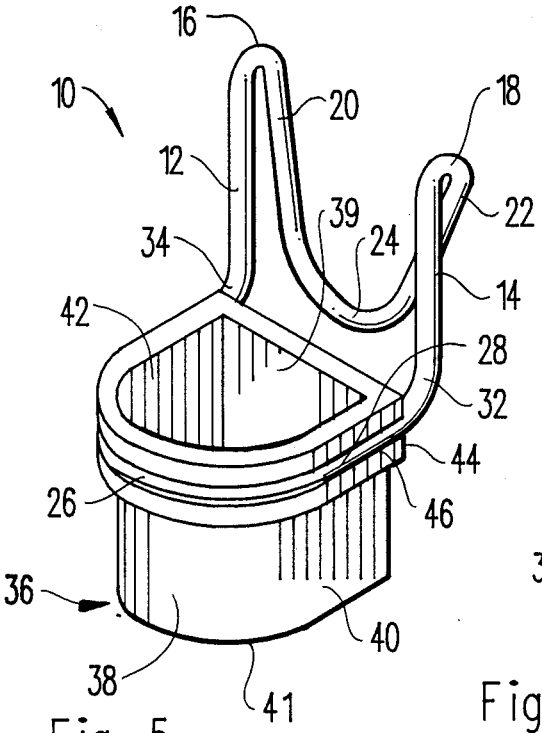
FIG. 5 is a perspective view of the tool carrier including a removable tool receptacle.

FIG. 5 illustrates the tool carrier 10 with a removable tool receptacle 36 installed in the tool insertion portion of the frame. The receptacle 36 includes generally parallel side walls 40 and 42 connected by an arcuate front wall 38 and a planar back wall 39. A peripheral groove 46 is configured for engagement with the side rail members 28 and 30 and the arcuate connecting bar 26 of the tool carrier frame. The tool receptacle 36 preferably has an enlarged radially extending peripheral rim 44 which forms a frictional mounting surface for removably securing the receptacle 36 within the tool insertion portion of the carrier 10. A planar bottom surface connects the side walls 40, 42, the front wall 38 and the back wall 39 to form a small container for small hand tools and miscellaneous hardware items. It should be noted that the arcuate connecting bar 24 is slightly vertically spaced above the radiused bends 32 and 34 to allow lateral insertion of the enlarged rim portion 44 of the receptacle 36. The receptacle 36 is preferably formed from a molded plastic material which affords a slight resilience which affords a snap-in type installation.

Figure 6:
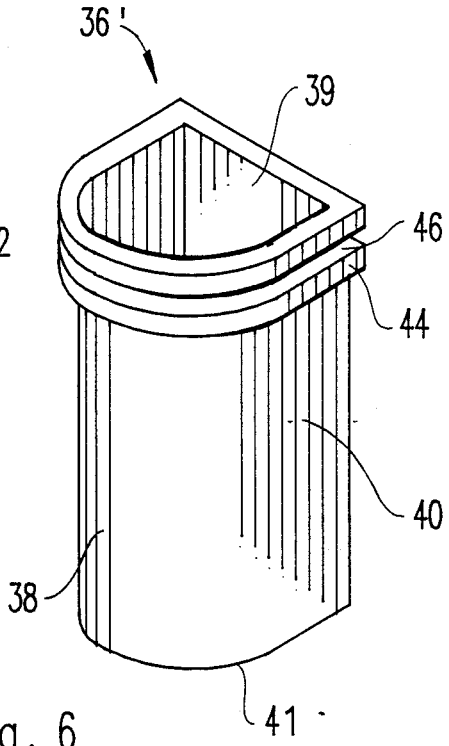
FIG. 6 is a perspective view illustrating an alternative form of tool receptacle.

FIG. 6 illustrates an alternative receptacle 36' which has an elongated length to provide a greater depth or retaining power tools such as power drills, screw drivers, or blow dryers. The receptacle 36' may have a planar bottom surface 41 or may alternatively be open-ended to form an elongated sheath.

Figure 7:
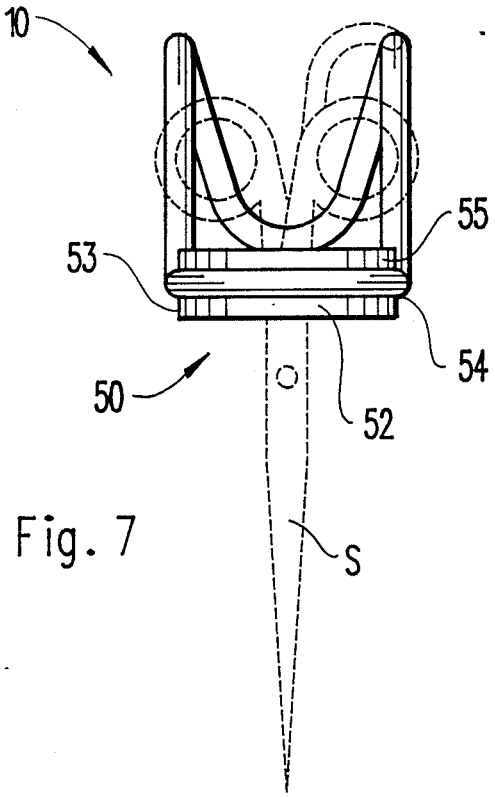
FIG. 7 illustrates a front view of the tool carrier according to the present invention, with a removable tool receptacle for carrying a pair of scissors or other tool blades.

FIG. 7 is a front view which illustrates a third form of the tool receptacle 50 having an arcuate front wall 52, connecting parallel side walls 53 and 55. A peripheral groove 54 is provided to allow a snap-in type attachment of the receptacle 50 on the tool insertion portion of the carrier 10. The receptacle 50 allows the convenient transportation of a pair of scissors S, or other bladed tools such as screw drivers and scrapers.

Figure 8:
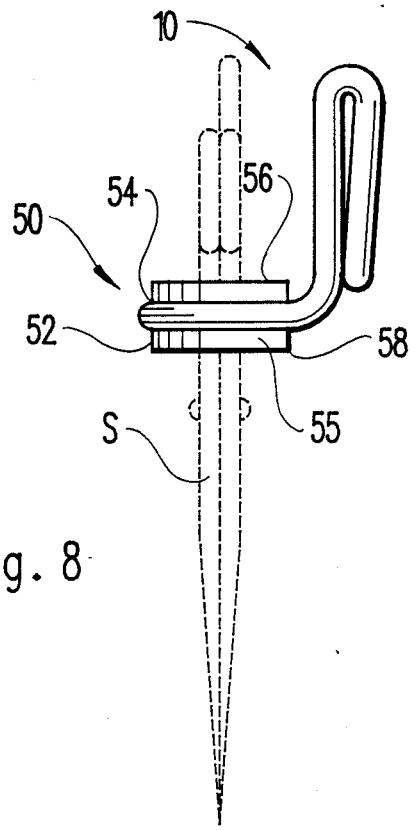
FIG. 8 is a side view of the tool carrier assembly of FIG. 7.

FIG. 8 is a side view which illustrates the planar top surface 56 of the receptacle 50 which extends between the side walls 53, 54, the front wall 52 and the planar back wall 58.

Figure 9:
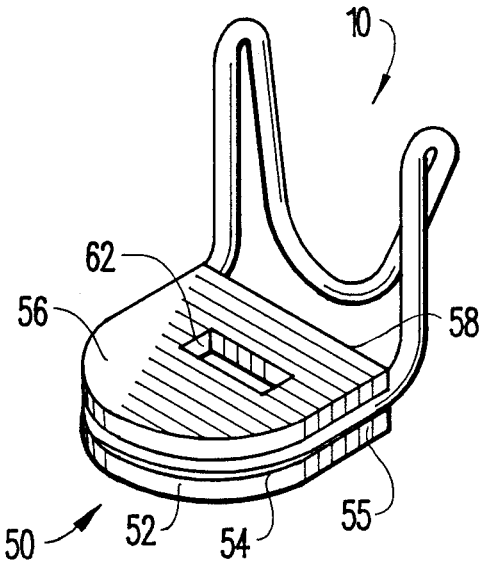
FIG. 9 is a perspective view of the tool carrier assembly of FIG. 7.

As shown in FIG. 9, a rectangular slot 62 is formed centrally through the top surface 56 of the scissors carrying tool receptacle 50.

Figure 10:
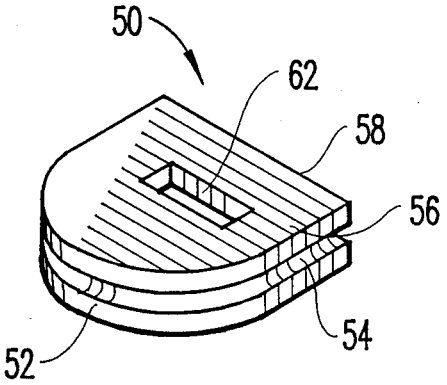
FIG. 10 is a perspective view illustrating the scissors carrying tool receptacle

FIG. 10 is a perspective view illustrating the receptacle 50, removed from the carrier 10. The peripheral groove 54 is dimensioned for frictional engagement within the tool insertion portion of the carrier 10, as shown in FIG. 9.

Figure 11:
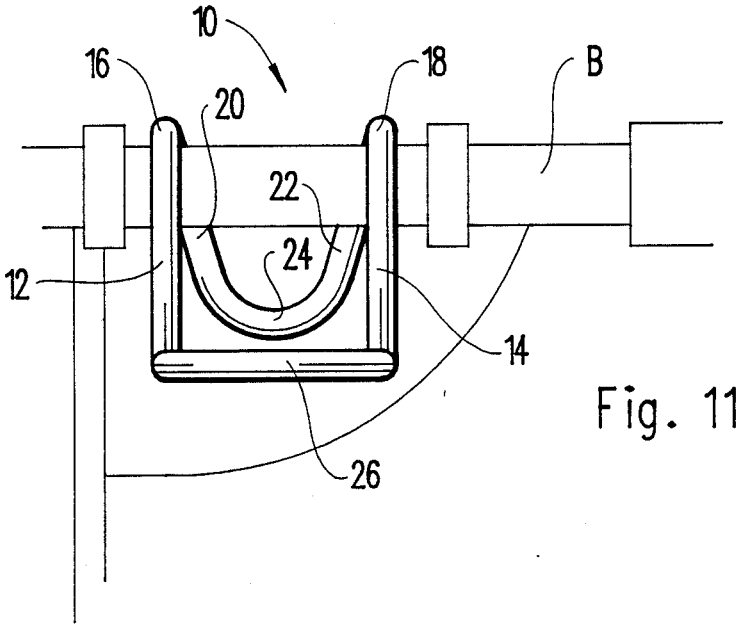
FIG. 11 is a front view illustrating the manner of mounting the tool carrier of the present invention on a belt of an individual.

FIG. 11 diagrammaticallY illustrates the mounting of the tool carrier 10 on the belt B of an individual. The belt B is frictionally clamped between the attachment rail members 12, 14 and the clip members 20 and 22. Alternatively, an individual may secure the tool carrier 10 in the waist band of their trousers, if a belt is not employed.

Figure 12:
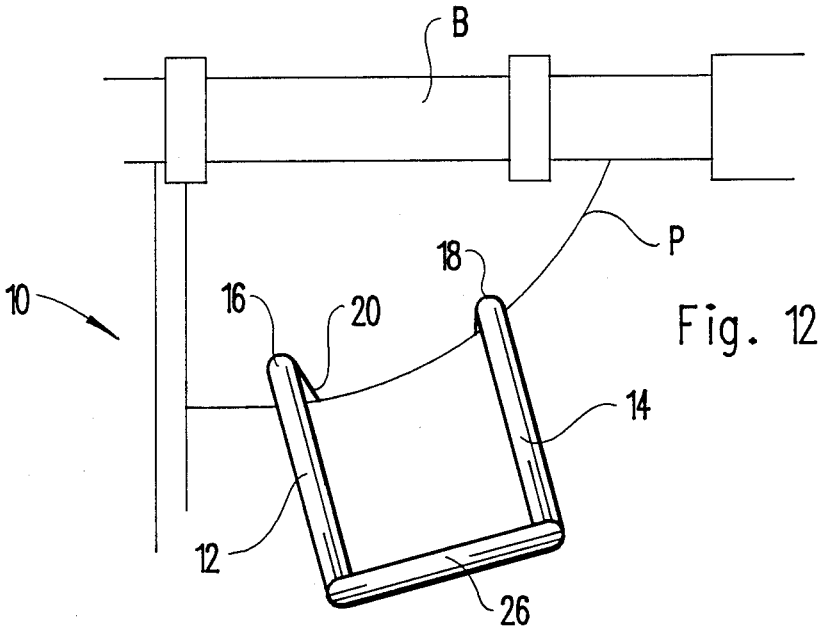
FIG. 12 is a front view illustrating the manner of mounting the tool carrier of the present invention within a pocket of an individual.

FIG. 12 is a diagrammatic view which illustrates the carrier 10 secured on the pocket P, beneath the belt B of the trousers of an individual. This affords a slightly lower and inclined mounting of the tool carrier 10, which positions a tool for more convenient use.

As may now be understood, the present invention discloses an extremely simple and inexpensive tool carrier, which, through the use of a set of various different snap-in tool receptacles, may be utilized to conveniently transport a wide variety of different tools for convenient usage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tool carrier, comprising:

a frame formed from a closed loop of wire;

said frame having a tool insertion portion including spaced opposed side rail members connected by an arcuate end bar, said side rail members and said end bar lying in a first common plane;

a pair of spaced attachment rail members, each connected by an approximately 90 degree radius bend with one of said side rail members, said attachment rail members lying in a second common plane generally perpendicular to said first common plane;

pair of converging clip members, each connected by an approximately 180 degree radius bend with one of said attachment rail members, said clip members connected by an arcuate connecting bar and forming a resilient frictional clip for securement to an article of apparel of an individual;

a receptacle removably secured in said tool insertion portion, between said side rail members;

said receptacle having parallel side walls connected by an arcuate front wall and a planar back wall; and said side walls, said front wall, and said back wall defining an elongated sheath for insertion of a tool.

2. The tool carrier of claim 1, wherein said receptacle includes a peripheral groove dimensioned for engagement with said side rail members and said arcuate end bar.

3. The tool carrier of claim 1, wherein said receptacle has a planar surface extending between said side walls, said front wall, and said back wall, and provided with a slot for receiving a tool blade.

4. The tool carrier of claim 1, further comprising a bottom surface connecting said side walls, said front wall and said back wall for retaining small articles.

5. The tool carrier of claim 1, further comprising a friction enhancing coating on said frame.

6. A tool carrier, comprising:

a frame formed from a closed wire loop;

said frame having a tool insertion portion formed by spaced side rail members connected by an arcuate end bar;

an attachment portion of said frame having spaced attachment rail members each connected by an approximately 90 degree radius bend with one of said side rail members;

a clip portion of said frame having spaced clip members connected by an arcuate connecting bar, each of said clip members connected by an approximately 180 degree radius bend with one of said attachment rail members;

a receptacle removably secured in said tool insertion portion, between said side rail members;

said receptacle having parallel side walls connected by an arcuate front wall and a planar back wall; and said side walls, said front wall, and said back wall defining an elongated sheath for insertion of a tool.

7. The tool carrier of claim 6, further comprising a bottom surface connecting said side walls, said front wall and said back wall for retaining small articles.

8. The tool carrier of claim 6, further comprising a friction enhancing coating on said frame.

9. The tool carrier of claim 6, wherein said receptacle includes a peripheral groove dimensioned for engagement with said side rail members and said arcuate end bar.

10. The tool carrier of claim 6, wherein said receptacle has a planar surface extending between said side walls, said front wall, and said back wall, and provided with a slot for receiving a tool blade.

11. A tool carrier, comprising;

a frame formed from a closed wire loop;

said frame having a tool insertion portion formed by spaced side rail members connected by an arcuate end bar;

an attachment portion of said frame having spaced attachment rail members each connected by an approximately 90 degree radius bend with one of said side rail members;

a clip portion of said frame having spaced clip members connected by an arcuate connecting bar, each of said clip members connected by an approximately 180 degree radius bend with one of said attachment rail members;

a receptacle removably secured in said tool insertion portion, between said side rail members;

said receptacle having parallel side walls connected by an arcuate front wall and a planar back wall;

and said receptacle having a peripheral groove extending around said front and side walls, said groove dimensioned for engagement with said side rail members and aid arcuate end bar.

12. The tool carrier of claim 11, further comprising a bottom surface connecting said side walls, said front wall and said back wall for retaining small articles.

13. The tool carrier of claim 11, further comprising a friction enhancing coating on said frame.

14. The tool carrier of claim 11, wherein said receptacle has a planar surface extending between said side walls, said front wall, and said back wall, and provided with a slot for receiving a tool blade.

15. The tool carrier of claim 11, wherein said side walls, said front wall, and said back wall defining an elongate sheath for insertion of a tool.

* * * * *